US007643988B2

(12) United States Patent
En-Najjary et al.

(10) Patent No.: US 7,643,988 B2
(45) Date of Patent: Jan. 5, 2010

(54) METHOD FOR ANALYZING FUNDAMENTAL FREQUENCY INFORMATION AND VOICE CONVERSION METHOD AND SYSTEM IMPLEMENTING SAID ANALYSIS METHOD

(75) Inventors: Taoufik En-Najjary, Valbonne (FR); Olivier Rosec, Lannion (FR)

(73) Assignee: France Telecom, Paris (FR)

( * ) Notice: Subject to any disclaimer, the term of this patent is extended or adjusted under 35 U.S.C. 154(b) by 494 days.

(21) Appl. No.: 10/551,224

(22) PCT Filed: Mar. 2, 2004

(86) PCT No.: PCT/FR2004/000483

§ 371 (c)(1),
(2), (4) Date: Feb. 27, 2006

(87) PCT Pub. No.: WO2004/088633

PCT Pub. Date: Oct. 14, 2004

(65) Prior Publication Data

US 2006/0178874 A1 Aug. 10, 2006

(30) Foreign Application Priority Data

Mar. 27, 2003 (FR) ..... 03 03790

(51) Int. Cl.
*G10L 11/04* (2006.01)

(52) U.S. Cl. ..... 704/207; 704/208; 704/220; 704/270

(58) Field of Classification Search ..... 704/207, 704/208, 231, 251, 220, 270–278
See application file for complete search history.

(56) References Cited

U.S. PATENT DOCUMENTS 5,327,521 A * 7/1994 Savic et al. ..... 704/272
6,615,174 B1 * 9/2003 Arslan et al. ..... 704/270

OTHER PUBLICATIONS

Doval B et al: "Fundamental frequency estimation and tracking using maximum likelihood harmonic matching and HMMs" Statistical Signal and Array Processing. Minneapolis, Apr. 27-30, 1993, Proceedings of the International Conference on Acoustics, Speech, and Signal Processing (ICASSP), New York, IEEE, US, vol. 4, Apr. 27, 1993, pp. 221-224, XP010110214 ISBN: 0-7803-0946-4 alinèa "Theory b)f0 likelihood" alinèa "Hidden Markov f0 tracking" idem.

(Continued)

*Primary Examiner*—Vijay B Chawan
(74) *Attorney, Agent, or Firm*—Young & Thompson

(57) ABSTRACT

A method for analyzing fundamental frequency information contained in voice samples includes at least one analysis step (2) for the voice samples which are grouped together in frames in order to obtain information relating to the spectrum and information relating to the fundamental frequency for each sample frame; a step (20) for the determination of a model representing the common characteristics of the spectrum and fundamental frequency of all samples; and a step (30) for determination of a fundamental frequency prediction function exclusively according to spectrum-related in formation on the basis of the model and voice samples.

20 Claims, 3 Drawing Sheets

OTHER PUBLICATIONS

Stylianou Y et al: "A System for Voice Conversion Based on Probabilistic Classification and a Harmonic Plus Noise Model" Proceedings of the 1998 IEEE International Conference on Acoustics, Speech and Signal Processing. ICASSP '98. Seattle , WA, May 12-15, 1998, IEEE International Conference on Acoustics, Speech and Signal Processing, New York, NY: IEEE, US, vol. 1 Conf. 23, May 12, 1998, pp. 281-284, XP000854570 ISBN: 0-7803-4429-4 paragraphs '02. 2!, '0003!, '04.2!, '04.3 !paragraph '04.2 !figure 1.

Kain A et al: "Stochastic modeling of spectral adjustment for high quality pitch modification" ICASSP 2000, vol. 2, Jun. 5, 2000, pp. 949-952, XP010504881 paragraph '0002!.

* cited by examiner

METHOD FOR ANALYZING FUNDAMENTAL FREQUENCY INFORMATION AND VOICE CONVERSION METHOD AND SYSTEM IMPLEMENTING SAID ANALYSIS METHOD

CROSS-REFERENCE TO RELATED APPLICATIONS

The present Application incorporates by reference and claims priority to PCT/FR2004/000483 filed Mar. 2, 2004 and French Patent Application 03/03790 file Mar. 27, 2003.

STATEMENT REGARDING FEDERALLY SPONSORED RESEARCH OR DEVELOPMENT

None.

THE NAMES OF THE PARTIES TO A JOINT RESEARCH AGREEMENT

None.

INCORPORATION-BY-REFERENCE OF MATERIAL SUBMITTED ON A COMPACT DISC

None.

BACKGROUND OF THE INVENTION

1. Field of the Invention

The present invention relates to a method for analyzing fundamental frequency information contained in voice samples, and a voice conversion method and system implementing said analysis method.

2. Description of Related Art

Depending on the nature of the sounds to be produced, production of speech, and in particular voiced sounds, may entail vibration of the vocal chords, which manifests itself through the presence in the speech signal of a periodic structure having a fundamental period, the inverse of which is referred to as the fundamental frequency or pitch.

In certain applications, such as voice conversion, aural rendering is of vital importance, and effective control of the parameters linked to prosody, including the fundamental frequency, is required in order to obtain acceptable quality.

Thus, numerous methods currently exist for analyzing the fundamental frequency information contained in voice samples.

These analyses enable the determination and modeling of fundamental frequency characteristics. For example, methods exist which enable determination of the slope or an amplitude scale of the fundamental frequency over an entire database of voice samples.

Knowledge of these parameters enables modifications of speech signals to be made, for example by fundamental frequency scaling between source and target speakers, in such a way as to globally respect the mean and the variation of the fundamental frequency of the target speaker.

However, these analyses enable only general representations to be obtained, and not fundamental frequency representations whose parameters can be defined, and are therefore not relevant, in particular to speakers whose speaking styles differ.

The object of the present invention is to overcome this problem by defining a method for analyzing fundamental frequency information of voice samples, making it possible to define a fundamental frequency representation whose parameters can be defined.

BRIEF SUMMARY OF THE INVENTION

For this purpose, the subject of the present invention is a method for analyzing fundamental frequency information contained in voice samples, characterized in that it comprises at least:

- a step for the analysis of the voice samples grouped together in frames in order to obtain, for each sample frame, spectrum-related information and information relating to the fundamental frequency;
- a step for the determination of a model representing the common characteristics of the spectrum and fundamental frequency of all samples; and
- a step for the determination of a fundamental frequency prediction function exclusively according to spectrum-related information on the basis of said model and voice samples.

According to other characteristics of this analysis method:

- said analysis step is adapted to supply said spectrum-related information in the form of cepstral coefficients;
- said analysis step comprises:
  - a sub-step for modeling voice samples according to a sum of a harmonic signal and a noise signal;
  - a sub-step for estimating frequency parameters, and at least the fundamental frequency of the voice samples;
  - a sub-step for synchronized analysis of the fundamental frequency of each sample frame; and
  - a sub-step for estimating the spectral parameters of each sample frame;
- it furthermore comprises a step for normalizing the fundamental frequency of each sample frame in relation to the mean of the fundamental frequencies of the analyzed samples;
- said step for the determination of a model corresponds to the determination of a model by mixing Gaussian densities;
- said model determination step comprises:
  - a sub-step for determining a model corresponding to a mixture of Gaussian densities; and
  - a sub-step for estimating the parameters of the mixture of Gaussian densities on the basis of the estimation of the maximum resemblance between the spectral information and the fundamental frequency information of the samples and of the model;
- said step for the determination of a prediction function is implemented on the basis of an estimator of the implementation of the fundamental frequency, knowing the spectral information of the samples;
- said step for determining the fundamental frequency prediction function comprises a sub-step for determining the conditional expectation of the implementation of the fundamental frequency, knowing the spectral information, on the basis of the a posteriori probability that the spectral information is obtained on the basis of the model, the conditional expectation forming said estimator.

The invention also relates to a method for the conversion of a voice signal pronounced by a source speaker into a converted voice signal whose characteristics resemble those of a target speaker, comprising at least:

- a step for determining a function for the transformation of spectral characteristics of the source speaker into spectral characteristics of the target speaker, implemented on the basis of voice samples of the source speaker and the target speaker; and a step for transforming spectral information of the voice signal of the source speaker to be converted with the aid of said transformation function, characterized in that it furthermore comprises:

a step for determining a fundamental frequency prediction function exclusively according to spectrum-related information for the target speaker, said prediction function being obtained with the aid of an analysis method as defined above; and a step for predicting the fundamental frequency of the voice signal to be converted by applying said fundamental frequency prediction function to said transformed spectral information of the voice signal of the source speaker.

According to other characteristics of this conversion method:

said step for determining a transformation function is implemented on the basis of an estimator of the implementation of the target spectral characteristics, knowing the source spectral characteristics;

said step for determining a transformation function comprises:

a sub-step for modeling the source and target voice samples according to a sum model of a harmonic signal and a noise signal;

a sub-step for aligning the source and target samples; and a sub-step for determining said transformation function on the basis of the calculation of the conditional expectation of the implementation of the target spectral characteristics, knowing the implementation of the source spectral characterizations, the conditional expectation forming said estimator.

said transformation function is a spectral envelope transformation function;

it furthermore comprises a step for analyzing the voice signal to be converted, adapted to supply said spectrum-related information and information relating to the fundamental frequency;

it furthermore comprises a synthesis step, enabling the formation of a converted voice signal on the basis of at least the transformed spectral information and the predicted fundamental frequency information.

The invention also relates to a system for converting a voice signal pronounced by a source speaker into a converted voice signal whose characteristics resemble those of a target speaker, said system comprising at least:

means for determining a function for transforming spectral characteristics of the source speaker into spectral characteristics of the target speaker, receiving, at their input, voice samples of the source speaker and of the target speaker; and means for transforming spectral information of the voice signal of the source speaker to be converted by applying said transformation function supplied by the means, characterized in that it furthermore comprises:

means for determining a fundamental frequency prediction function exclusively according to spectrum-related information for the target speaker, adapted for the implementation of an analysis method, on the basis of voice samples of the target speaker; and means for predicting the fundamental frequency of said voice signal to be converted by applying said prediction function determined by said means for determining a prediction function to said transformed spectral information supplied by said transformation means.

According to other characteristics of this system:

it furthermore comprises:

means for analyzing the voice signal to be converted, adapted to supply, at their output, spectrum-related information and information relating to the fundamental frequency of the voice signal to be converted; and synthesis means enabling the formation of a converted voice signal on the basis of at least the transformed spectral information supplied by the means and the predicted fundamental frequency information supplied by the means;

said means for determining a transformation function are adapted to supply a spectral envelope transformation function;

it is adapted for the implementation of a voice conversion method as defined above.

BRIEF DESCRIPTION OF THE SEVERAL VIEWS OF THE DRAWINGS

The invention will be more readily understood from a reading of the description which follows, provided purely as an example and with reference to the attached drawings, in which.

DETAILED DESCRIPTION OF THE INVENTION

Figure 1:
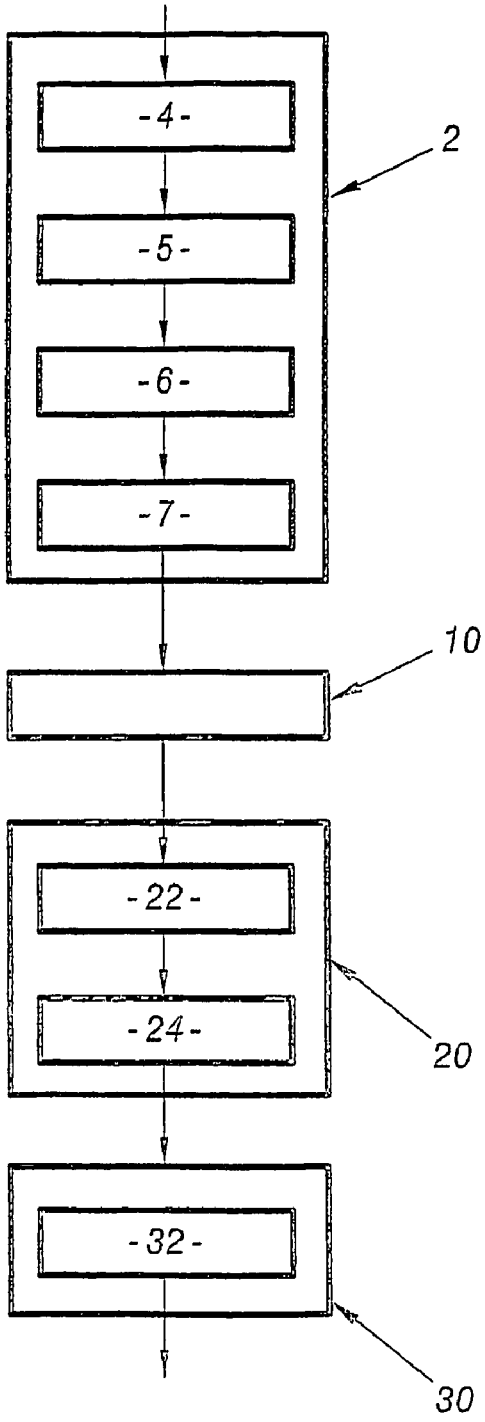
FIG. 1 is a flowchart of an analysis method according to the invention.

The method according to the invention shown in FIG. 1 is implemented on the basis of a database of voice samples containing sequences of natural speech.

The method starts with a step 2 for analyzing samples by grouping them together in frames, in order to obtain, for each sample frame, spectrum-related information and, in particular, information relating to the spectral envelope, and information relating to the fundamental frequency.

In the embodiment described, this analysis step 2 is based on the use of a model of a sound signal in the form of a sum of a harmonic signal and a noise signal according to a model normally referred to as "HNM" (Harmonic plus Noise Model).

Moreover, the embodiment described is based on a representation of the spectral envelope by the discrete cepstrum.

A cepstral representation in fact enables separation, in the speech signal, of the component relating to the vocal tract from the resulting source component, corresponding to the vibrations of the vocal chords and characterized by the fundamental frequency.

Thus, analysis step 2 comprises a sub-step 4 for modeling each voice signal frame into a harmonic part representing the periodic component of the signal, consisting of a sum of L harmonic sinusoids with amplitude $A_l$ and phase $\phi_l$, and a noisy part representing the friction noise and glottal excitation variation.

This can therefore be formulated as follows:

$$s(n) = h(n) + b(n)$$

where $$h(n) = \sum_{l=1}^{L} A_1(n)\cos(\phi_1(n))$$

The term h(n) therefore represents the harmonic approximation of the signal s(n).

Step 2 then comprises a sub-step 5 for estimating, for each frame, frequency parameters, of the fundamental frequency in particular, for example by means of an autocorrelation method.

In a conventional manner, this HNM analysis supplies the maximum voicing frequency. As a variant, this frequency may be arbitrarily defined, or may be estimated by other known means.

This sub-step 5 is followed by a sub-step 6 for synchronized analysis of the fundamental frequency of each frame, enabling estimation of the parameters of the harmonic part and the parameters of the signal noise.

In the embodiment described, this synchronized analysis corresponds to the determination of the harmonic parameters through minimization of a weighted least squares criterion between the full signal and its harmonic breakdown, corresponding, in the embodiment described, to the estimated noise signal. The criterion denoted as E is equal to:

$$E = \sum_{n=-T_i}^{T_i} w^2(n)(s(n) - h(n))^2$$

In this equation, w(n) is the analysis window and $T_i$ is the fundamental period of the current frame.

Thus, the analysis window is centered around the fundamental period marker and its duration is twice this period.

The analysis step 2 lastly comprises a sub-step 7 for estimating the parameters of the components of the spectral envelope of the signal, using, for example, a regularized discrete cepstrum method and a Bark-scale transformation in order to reproduce the properties of the human ear as faithfully as possible.

Thus, the analysis step 2 supplies, for each frame of order n of speech signal samples, a scalar denoted as $x_n$, comprising fundamental frequency information, and a vector denoted as $y_n$, comprising spectral information in the form of a sequence of cepstral coefficients.

Advantageously, the analysis step 2 is followed by a step 10 for normalizing the value of the fundamental frequency of each frame in relation to the mean fundamental frequency in order to replace, in each voice sample frame, the value of the fundamental frequency with a fundamental frequency value normalized according to the following formula:

$$F_{\log} = \log\left(\frac{F_o}{F_o^{moy}}\right)$$

In this formula, $F_o^{moy}$ corresponds to the mean of the values of the fundamental frequencies over the entire analyzed database.

This normalization enables modification of the scale of the variations of the fundamental frequency scalars in order to make it consistent with the scale of the cepstral coefficient variations.

The normalization step 10 is followed by a step 20 for determining a model representing the common cepstrum and fundamental frequency characteristics of all the analyzed samples.

The embodiment described involves a probabilistic model of the fundamental frequency and of the discrete cepstrum according to a Gaussian densities mixture model, generally referred to as "GMM", the parameters of which are estimated on the basis of the joint density of the normalized fundamental frequency and the discrete cepstrum.

In a conventional manner, the probability density of a random variable denoted in a general manner as p(z), according to a Gaussian densities mixture model GMM, is denoted mathematically in the following manner:

$$p(z) = \sum_{i=1}^{Q} \alpha_i = N\left(z, \mu_i, \sum_i\right)$$

where $$\sum_{i=1}^{Q} \alpha_i, = 1, o \le \alpha_i \le 1$$

In this formula, $N(z: \mu_i; \Sigma_i)$ is the probability density of the normal law of mean $\mu_i$ and the covariance matrix $\Sigma_i$ and the coefficients $\alpha_i$ are the coefficients of the mixture.

Thus, the coefficient $\alpha_i$ corresponds to the a priori probability that the random variable z is generated by the $i^{th}$ Gaussian of the mixture.

In a more particular manner, the step 20 for determining the model comprises a sub-step 22 for modeling the joint density of the cepstrum denoted as y and the normalized fundamental frequency denoted as x, in such a way that:

$$p(z) = p(y, x), \text{ where } z = \begin{pmatrix} y \\ x \end{pmatrix}$$

In these equations, $x=[x_1, x_2, \ldots x_N]$ corresponds to the sequence of the scalars containing the normalized fundamental frequency information for N voice sample frames and $y=[y_1, y_2, \ldots y_N]$ corresponds to the sequence of the corresponding cepstrum coefficient vectors.

The step 20 then comprises a sub-step 24 for estimating GMM parameters $(\alpha, \mu, \Sigma)$ of the density p(z). This estimation may be implemented, for example, with the aid of a conventional algorithm of the type known as "EM" (Expectation Maximization), corresponding to an iterative method by means of which an estimator of the maximum resemblance between the speech sample data and the Gaussian mixture model is obtained.

The determination of the initial parameters of the GMM model is obtained with the aid of a conventional vector quantification technique.

The model determination step 20 thus supplies the parameters of a mixture of Gaussian densities representing common spectral characteristics, represented by the cepstrum coefficients, and fundamental frequencies of the analyzed voice samples.

The method then comprises a step 30 for determining, on the basis of the model and voice samples, a fundamental frequency prediction function exclusively according to spectral information supplied by the signal cepstrum.

This prediction function is determined on the basis of an estimator of the implementation of the fundamental frequency, given the cepstrum of the voice samples, formed in the embodiment described by the conditional expectation.

For this purpose, the step 30 comprises a sub-step 32 for determining the conditional expectation of the fundamental frequency, knowing the spectrum-related information supplied by the cepstrum. The conditional expectation is denoted as F(y) and is determined on the basis of the following formulae:

$$F(y) = E[x|y] = \sum_{i=1}^{Q} P_i(y)[\mu_i^x + \sum_i^{xy} (\sum_i^{yy})^{-1} (y - \mu_i^y)]$$

where $$P_i(y) = \frac{\alpha_i N\left(y, \mu_i^y, \sum_i^{yy}\right)}{\sum_{j=1}^{Q} \alpha_j N\left(y, \mu_j^y, \sum_j^{yy}\right)}$$

where $$\sum_i = \begin{bmatrix} \sum_i^{yy} \sum_i^{yx} \\ \sum_i^{xy} \sum_i^{xx} \end{bmatrix} \text{ and } \mu_i = \begin{bmatrix} \mu_i^x \\ \mu_i^y \end{bmatrix}$$

In these equations, $P_i(y)$ corresponds to the a posteriori probability that the cepstrum vector y is generated by the $i^{th}$ component of the Gaussian mixture of the model, defined in step 20 by the covariance matrix $\Sigma_i$ and the normal law $\mu_i$.

The determination of the conditional expectation thus enables the fundamental frequency prediction function to be obtained from the cepstrum information.

As a variant, the estimator implemented in step 30 may be an a posteriori maximum criterion, referred to as "MAP", and corresponding to the implementation of the expectation calculation exclusively for the model best representing the source vector.

It is clear therefore that the analysis method according to the invention enables, on the basis of the model and the voice samples, a fundamental frequency prediction function to be obtained exclusively according to spectral information supplied, in the embodiment described, by the cepstrum.

A prediction function of this type then enables the fundamental frequency value for a speech signal to be determined exclusively on the basis of spectral information of this signal, thereby enabling a relevant prediction of the fundamental frequency, in particular for sounds which are not in the analyzed voice samples.

Figure 2:
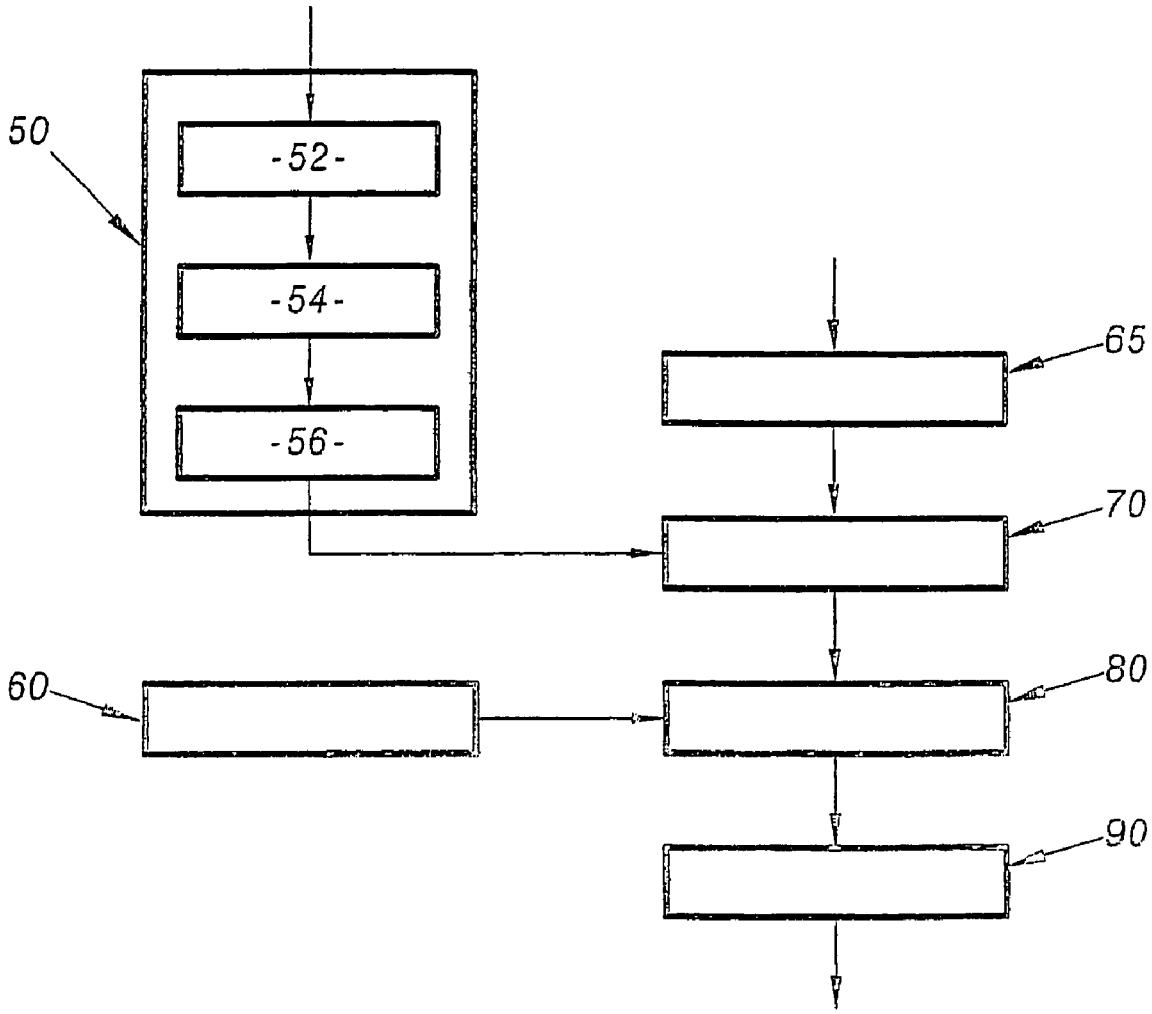
FIG. 2 is a flowchart of a voice conversion method implementing the analysis method according to the invention.

With reference to FIG. 2, the use of an analysis method according to the invention will now be described within the context of voice conversion.

Voice conversion consists in modifying the voice signal of a reference speaker known as the "source speaker" in such a way that the signal produced appears to have been pronounced by a different speaker referred to as the "target speaker".

This method is implemented using a database of voice samples pronounced by the source speaker and the target speaker.

In a conventional manner, a method of this type comprises a step 50 for determining a transformation function for the spectral characteristics of the voice samples of the source speaker to make them resemble the spectral characteristics of the voice samples of the target speaker.

In the embodiment described, this step 50 is based on an HNM analysis which enables the relationships between the characteristics of the spectral envelope of the voice signals of the source and target speakers to be determined.

Source and target voice recordings corresponding to the acoustic realization of the same phonetic sequence are required for this purpose.

The step 50 comprises a sub-step 52 for modeling voice samples according to an HNM sum model of harmonic and noise signals.

The sub-step 52 is followed by a sub-step 54 enabling alignment of the source and target signals with the aid, for example, of a conventional alignment algorithm known as "DTW" (Dynamic Time Warping).

Step 50 then comprises a sub-step 56 for determining a model such as a GMM model representing the common characteristics of the voice sample spectra of the source and target speakers.

In the embodiment described, a GMM model is used which comprises 64 components and a single vector containing the cepstral parameters of the source and target, in such a way that a spectral transformation function can be defined which corresponds to an estimator of the realization of the target spectral parameters denoted as t, knowing the source spectral parameters denoted as s.

In the embodiment described, this transformation function denoted as F(s) is denoted in the form of a conditional expectation obtained by the following formula:

$$F(s) = E[t|s] = \sum_{i=1}^{Q} P_I(s)[\mu_i^t + \sum_i^{ts} (\sum_i^{ss})^{-1} (s - \mu_i^s)]$$

where $$P_i(s) = \frac{\alpha_i N\left(s, \mu_i^s, \sum_i^{ss}\right)}{\sum_{j=1}^{Q} \alpha_j N\left(t, \mu_j^s, \sum_j^{ss}\right)}$$

where $$\sum_i = \begin{bmatrix} \sum_i^{ss} \sum_i^{st} \\ \sum_i^{ts} \sum_i^{tt} \end{bmatrix} \text{ and } \mu_i = \begin{bmatrix} \mu_i^s \\ \mu_i^t \end{bmatrix}$$

The precise determination of this function is obtained through maximization of the resemblance between the source and the target parameters, obtained by means of an EM algorithm.

As a variant, the estimator may be formed from an a posteriori maximum criterion.

The function thus defined therefore enables modification of the spectral envelope of a speech signal originating from the source speaker in order to make it resemble the spectral envelope of the target speaker.

Prior to this maximization, the parameters of the GMM model representing the common spectral characteristics of the source and target are initialized, for example, with the aid of a vector quantification algorithm.

In parallel, the analysis method according to the invention is implemented in a step 60 in which only the voice samples of the target speaker are analyzed.

As described with reference to FIG. 1, the analysis step 60 according to the invention enables a fundamental frequency prediction function to be obtained for the target speaker, exclusively on the basis of spectral information.

The conversion method then comprises a step 65 in which a voice signal to be converted, pronounced by the source speaker, is analyzed, said signal to be converted being different from the voice signals used in steps 50 and 60.

This analysis step 65 is implemented, for example, with the aid of a breakdown according to the HNM model, enabling the provision of spectral information in the form of cepstral coefficients, fundamental frequency information and maximum frequency and phase voicing information.

This step 65 is followed by a step 70 in which the spectral characteristics of the voice signal to be converted are transformed by applying the transformation function determined in step 50 to the cepstral coefficients defined in step 65.

This step 70 in particular modifies the spectral envelope of the voice signal to be converted.

At the end of step 70, each frame of samples of the source speaker signal to be converted is thus associated with transformed spectral information whose characteristics are similar to the spectral characteristics of the samples of the target speaker.

The conversion method then comprises a fundamental frequency prediction step 80 for the voice samples of the source speaker, by applying the prediction function determined using the method according to the invention in step 60, exclusively to the transformed spectral information associated with the source speaker voice signal to be converted.

In fact, as the voice samples of the source speaker are associated with transformed spectral information whose characteristics are similar to those of the target speaker, the prediction function defined in step 60 enables a relevant prediction of the fundamental frequency to be obtained.

In a conventional manner, the conversion method then comprises an output signal synthesis step 90, implemented, in the example described, by an HNM synthesis which directly supplies the voice signal converted on the basis of the transformed spectral envelope information supplied in step 70, the predicted fundamental frequency information produced in step 80 and the maximum frequency and phase voicing information supplied by step 65.

The conversion method implementing the analysis method according to the invention thus enables a voice conversion to be obtained which implements spectral modifications and a fundamental frequency prediction in such a way as to obtain a high-quality aural rendering.

In particular, the effectiveness of a method of this type can be evaluated on the basis of identical voice samples pronounced by the source speaker and the target speaker.

The voice signal pronounced by the source speaker is converted with the aid of the method as described, and the resemblance between the converted signal and the signal pronounced by the target speaker is evaluated.

For example, this resemblance is calculated in the form of a ratio between the acoustic distance separating the converted signal from the target signal and the acoustic distance separating the target signal from the source signal.

In calculating the acoustic distance on the basis of the cepstral coefficients or the signal amplitude spectrum obtained with the aid of these cepstral coefficients, the ratio obtained for a signal converted with the aid of the method according to the invention is in the order of 0.3 to 0.5.

Figure 3:
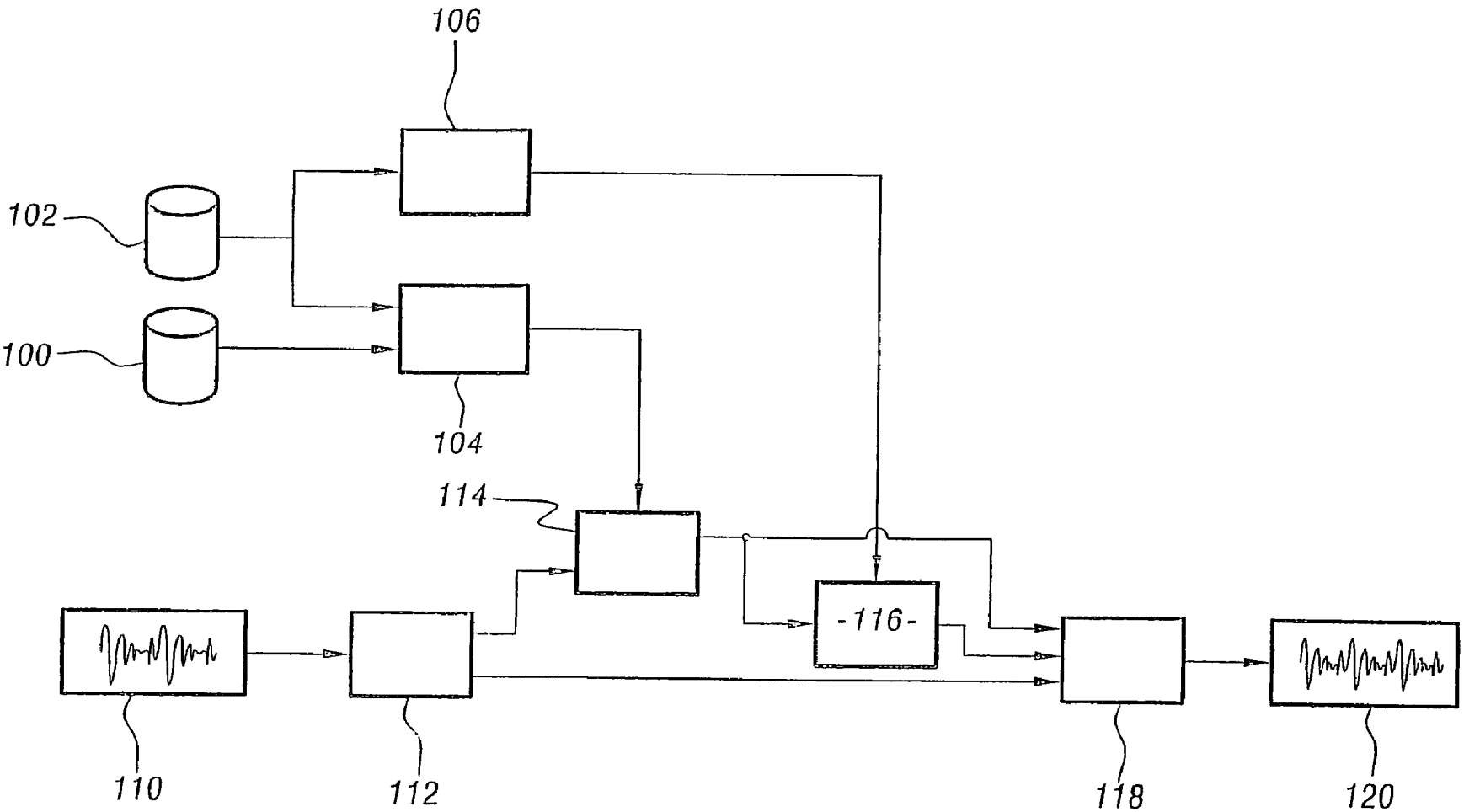
FIG. 3 is a functional block diagram of a voice conversion system, enabling the implementation of the method according to the invention described in FIG. 2.

FIG. 3 shows a functional block diagram of a voice conversion system implementing the method described with reference to FIG. 2.

This system uses at its input a database 100 of voice samples pronounced by the source speaker and a database 102 containing at least the same voice samples pronounced by the target speaker.

These two databases are used by a module 104 which determines a function for transforming spectral characteristics of the source speaker into spectral characteristics of the target speaker.

This module 104 is adapted for the implementation of step 50 of the method as described with reference to FIG. 2, and therefore enables the determination of a spectral envelope transformation function.

Furthermore, the system comprises a module 106 for determining a fundamental frequency prediction function exclusively according to spectrum-related information. To do this, the module 106 receives at its input voice samples of the target speaker only, contained in the database 102.

The module 106 is adapted for the implementation of step 60 of the method described with reference to FIG. 2, corresponding to the analysis method according to the invention as described with reference to FIG. 1.

The transformation function supplied by the module 104 and the prediction function supplied by the module 106 are advantageously stored with a view to subsequent use.

The voice conversion system receives at its input a voice signal 110 corresponding to a speech signal pronounced by the source speaker and intended to be converted.

The signal 110 is introduced into a signal analysis module 112, implementing, for example, an HNM breakdown and enabling dissociation of the spectral information of the signal 110 in the form of cepstral coefficients and fundamental frequency information. The module 112 also supplies maximum frequency and phase voicing information obtained by applying the HNM model.

The module 112 therefore implements the step 65 of the method previously described.

This analysis may possibly be carried out in advance, and the information is stored for subsequent use.

The cepstral coefficients supplied by the module 112 are then introduced into a transformation module 114 adapted to apply the transformation function determined by the module 104.

Thus, the transformation module 114 implements step 70 of the method described with reference to FIG. 2 and supplies the transformed cepstral coefficients whose characteristics are similar to the spectral characteristics of the target speaker.

The module 114 thus implements a modification of the spectral envelope of the voice signal 110.

The transformed cepstral coefficients supplied by the module 114 are then introduced into a fundamental frequency prediction module 116 adapted to implement the prediction function determined by the module 106.

Thus, the module 116 implements step 80 of the method described with reference to FIG. 2 and supplies at its output fundamental frequency information predicted exclusively on the basis of the transformed spectral information.

The system then comprises a synthesis module 118 receiving at its input the transformed cepstral coefficients originating from the module 114 and corresponding to the spectral envelope, the predicted fundamental frequency information originating from the module 116, and the maximum frequency and phase voicing information supplied by the module 112.

The module 118 thus implements step 90 of the method described with reference to FIG. 2 and supplies a signal 120 corresponding to the voice signal 110 of the source speaker, except that its spectral and fundamental frequency characteristics have been modified in order to be similar to those of the target speaker.

The system described may be implemented in various ways, in particular with the aid of a suitable computer program connected to sound acquisition hardware means.

Embodiments other than the embodiment described may of course be envisaged.

In particular, the HNM and GMM models may be replaced by other techniques and models known to the person skilled in the art, such as, for example, LSF (Line Spectral Frequencies) and LPC (Linear Predictive Coding) techniques, or format-related parameters.

The invention claimed is:

1. A method for analyzing fundamental frequency information contained in voice samples, comprising:

in a computer processing a step (2) for the analysis of the voice samples grouped together in frames in order to obtain, for each sample frame, information relating to the spectral envelope and information relating to the fundamental frequency;

a step (20) for the determination of a model representing the common characteristics of the spectral envelope and fundamental frequency of all said voice samples; and a step (30) for determining a prediction function for predicting the fundamental frequency according exclusively to said information relating to the spectral envelope on the basis of said model and voice samples.

2. The method as claimed in claim 1, wherein said analysis step (2) is adapted to supply said spectrum-related information in the form of cepstral coefficients.

3. The method as claimed in claim 1, wherein said analysis step (2) comprises:

a sub-step (4) for modeling voice samples according to a sum of a harmonic signal and a noise signal;

a sub-step (5) for estimating frequency parameters, and at least the fundamental frequency of the voice samples;

a sub-step (6) for synchronized analysis of the fundamental frequency of each sample frame; and a sub-step (7) for estimating the spectral parameters of each sample frame.

4. The method as claimed in claim 3, wherein said analysis step (2) is adapted to supply said spectrum-related information in the form of cepstral coefficients.

5. The method as claimed in claim 1, wherein it furthermore comprises a step (10) for normalizing the fundamental frequency of each sample frame in relation to the mean of the fundamental frequencies of the analyzed samples.

6. The method as claimed in claim 5, wherein said analysis step (2) is adapted to supply said spectrum-related information in the form of cepstral coefficients.

7. The method as claimed in claim 1, wherein said step (20) for the determination of a model corresponds to the determination of a model by mixing Gaussian densities.

8. The method as claimed in claim 7, wherein said model determination step (20) comprises:

a sub-step (22) for determining a model corresponding to a mixture of Gaussian densities; and a sub-step (24) for estimating the parameters of the mixture of Gaussian densities on the basis of the estimation of the maximum resemblance between the information relating to the spectral envelope and the fundamental frequency information of the samples and of the model.

9. The method as claimed in claim 1, wherein said step (30) for the determination of a prediction function is implemented on the basis of an estimator of the implementation of the fundamental frequency, knowing the information relating to the spectral envelope of the samples.

10. The method as claimed in claim 9, wherein said step (30) for determining the fundamental frequency prediction function comprises a sub-step (32) for determining the conditional expectation of the implementation of the fundamental frequency, knowing the information relating to the spectral envelope, on the basis of the a posteriori probability that the information relating to the spectral envelope is obtained on the basis of the model, the conditional expectation forming said estimator.

11. A method for the conversion of a voice signal pronounced by a source speaker into a converted voice signal whose characteristics resemble those of a target speaker, comprising at least:

in a computer processing a step (50) for determining a function for the transformation of characteristics of the spectral envelope of the source speaker into characteristics of the spectral envelope of the target speaker, implemented on the basis of voice samples of the source speaker and the target speaker; and a step (70) for transforming characteristics of the spectral envelope of the voice signal of the source speaker to be converted with the aid of said transformation function, wherein the method further comprises:

a step (60) for determining a prediction function for predicting a fundamental frequency exclusively according to information relating to the spectral envelope for the target speaker, said prediction function being obtained according to the method of claim 1; and a step (80) for predicting the fundamental frequency of the voice signal to be converted by applying said fundamental frequency prediction function to said transformed characteristics of the spectral envelope of the voice signal of the source speaker.

12. The method as claimed in claim 11, wherein said step (50) for determining a transformation function is implemented on the basis of an estimator of the implementation of the target spectral characteristics, knowing the source spectral characteristics.

13. The method as claimed in claim 12, wherein said step (50) for determining a transformation function comprises:

a sub-step (52) for modeling the source and target voice samples according to a sum model of a harmonic signal and a noise signal;

a sub-step (54) for aligning the source and target samples; and a sub-step (56) for determining said transformation function on the basis of the calculation of the conditional expectation of the implementation of the target spectral characteristics, knowing the implementation of the source spectral characterizations, the conditional expectation forming said estimator.

14. The method as claimed in claim 11, wherein said transformation function is a spectral envelope transformation function.

15. The method as claimed in claim 11, wherein the method further comprises a step (65) for analyzing the voice signal to be converted, adapted to supply said spectrum-related information and information relating to the fundamental frequency.

16. The method as claimed in claim 11, wherein the method further comprises a synthesis step (90), enabling the formation of a converted voice signal at least on the basis of the transformed characteristics of the spectral envelope and the predicted fundamental frequency information.

17. A system for converting a voice signal (110) pronounced by a source speaker into a converted voice signal (120) whose characteristics resemble those of a target speaker, said system comprising:

a computer, the computer programmed to process:

means (104) for determining a function for transforming characteristics of the spectral envelope of the source speaker into characteristics of the spectral envelope of the target speaker, receiving, at their input, voice signals of the source speaker (100) and of the target speaker (102); and means (114) for transforming characteristics of the spectral envelope of the voice signal (110) of the source speaker to be converted by applying said transformation function supplied by the means (104), wherein the system further comprises:

means (106) for determining a prediction function for predicting a fundamental frequency exclusively according to information relating to the spectral envelope for the target speaker, adapted for the implementation of an analysis method as claimed in claim 1, on the basis of voice samples (102) of the target speaker; and means (116) for predicting the fundamental frequency of said voice signal to be converted (110) by applying said prediction function determined by said means (106) for determining a prediction function to said transformed characteristics of the spectral envelope supplied by said transformation means (114).

18. The system as claimed in claim 17, further comprises:

means (112) for analyzing the voice signal to be converted (110), adapted to supply, at their output, spectrum-related information and information relating to the fundamental frequency of the voice signal to be converted; and synthesis means (118) enabling the formation of a converted voice signal on the basis of at least the transformed characteristics of the spectral envelope supplied by the means (114) and the predicted fundamental frequency information supplied by the means (116).

19. The system as claimed in claim 17, wherein said means (104) for determining a transformation function are adapted to supply a spectral envelope transformation function.

20. The system as claimed in claim 17, wherein the system is adapted for the implementation of a voice conversion method comprising:

a step (50) for determining a function for the transformation of spectral characteristics of the source speaker into spectral characteristics of the target speaker, implemented on the basis of voice samples of the source speaker and the target speaker; and a step (70) for transforming characteristics of the spectral envelope of the voice signal of the source speaker to be converted with the aid of said transformation function, a step (60) for determining a fundamental frequency prediction function exclusively according to spectrum-related information for the target speaker, said prediction function being obtained with the aid of an analysis method comprising:

a step (2) for the analysis of the voice samples grouped together in frames in order to obtain, for each sample frame, spectrum-related information and information relating to the fundamental frequency;

a step (20) for the determination of a model representing the common characteristics of the spectrum and fundamental frequency of all samples; and a step (30) for the determination of a fundamental frequency prediction function exclusively according to spectrum-related information on the basis of said model and voice samples; and a step (80) for predicting the fundamental frequency of the voice signal to be converted by applying said fundamental frequency prediction function to said transformed characteristics of the spectral envelope of the voice signal of the source speaker.

* * * * *

UNITED STATES PATENT AND TRADEMARK OFFICE

CERTIFICATE OF CORRECTION

PATENT NO. : 7,643,988 B2
APPLICATION NO. : 10/551224
DATED : January 5, 2010
INVENTOR(S) : En-Najjary et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 959 days.

Signed and Sealed this

Twenty-first Day of December, 2010

David J. Kappos

David J. Kappos
*Director of the United States Patent and Trademark Office*